US009790766B2

(12) United States Patent
Huffer et al.

(10) Patent No.: US 9,790,766 B2
(45) Date of Patent: Oct. 17, 2017

(54) INTERNAL ADJUSTMENTS TO AUTONOMOUS INFLOW CONTROL DEVICES

(71) Applicant: Halliburton Energy Services, Inc., Houston, TX (US)

(72) Inventors: William Ryan Huffer, Dallas, TX (US); Aaron Bonner, Flower Mound, TX (US); Gregory Scott Cunningham, Grapevine, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 384 days.

(21) Appl. No.: 14/390,653

(22) PCT Filed: Dec. 17, 2013

(86) PCT No.: PCT/US2013/075547

§ 371 (c)(1),
(2) Date: Oct. 3, 2014

(87) PCT Pub. No.: WO2015/094173

PCT Pub. Date: Jun. 25, 2015

(65) Prior Publication Data

US 2015/0376980 A1 Dec. 31, 2015

(51) Int. Cl.

| | |
|---|---|
| ***E21B 43/08*** | (2006.01) |
| ***E21B 43/12*** | (2006.01) |
| ***E21B 34/08*** | (2006.01) |
| ***E21B 34/06*** | (2006.01) |
| ***E21B 43/14*** | (2006.01) |

(52) U.S. Cl.
CPC ..... *E21B 34/06* (2013.01); *E21B 34/08* (2013.01); *E21B 43/12* (2013.01); *E21B 43/14* (2013.01)

(58) Field of Classification Search
CPC ..... E21B 43/08; E21B 43/12; E21B 34/08
USPC ..... 137/92; 166/296
See application file for complete search history.

(56) References Cited

U.S. PATENT DOCUMENTS 5,957,205 A * 9/1999 Bohme ..... E21B 37/08 166/227
7,419,002 B2 * 9/2008 Dybevik ..... E21B 43/12 166/169
2008/0135249 A1 6/2008 Fripp et al.
(Continued)

FOREIGN PATENT DOCUMENTS

WO 2015094173 A1 6/2015

OTHER PUBLICATIONS

International Search Report and Written Opinion for PCT/US2013/075547 dated Sep. 17, 2014.

*Primary Examiner* — Cathleen Hutchins
(74) *Attorney, Agent, or Firm* — McDermott Will & Emery LLP

(57) ABSTRACT

Disclosed are wellbore flow control devices that allow on-site field adjustments to flow characteristics. One autonomous inflow control device (AICD) assembly includes a base pipe defining one or more flow ports and an interior, at least one AICD arranged on the base pipe and having at least one fluid inlet and an outlet in fluid communication with one of the one or more flow ports, and a fluid barrier configured to be arranged about the at least one AICD by a well operator on-site and configured to isolate the at least one AICD from an influx of fluid during operation.

21 Claims, 4 Drawing Sheets

(56) References Cited

U.S. PATENT DOCUMENTS

| | | | | |
|---|---|---|---|---|
| 2008/0283238 | A1 | 11/2008 | Richards et al. | |
| 2010/0051270 | A1 | 3/2010 | Dusterhoft et al. | |
| 2011/0011577 | A1 | 1/2011 | Dusterhoft et al. | |
| 2011/0303420 | A1* | 12/2011 | Thorkildsen ..... | E21B 34/063 166/373 |
| 2013/0264072 | A1 | 10/2013 | Lopez et al. | |

* cited by examiner

INTERNAL ADJUSTMENTS TO AUTONOMOUS INFLOW CONTROL DEVICES

BACKGROUND

The present invention generally relates to wellbore flow control devices and, more specifically, to making on-site field adjustments to autonomous inflow control devices.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices (AICD) can be particularly advantageous in subterranean operations, since they are able to automatically regulate fluid flow without the need for operator control due to their design. In this regard, AICDs can be designed such that they provide a greater resistance to the flow of undesired fluids (e.g., gas and/or water) than they do desired fluids (e.g., oil), particularly as the percentage of the undesired fluids increases.

Several AICDs are often combined into an AICD system that can be manufactured to particular specifications and/or designs requested by well operators based on production needs for particular well sites. Such design specifications may include the required flow rate of fluids through the AICD system for normal operation. Upon receiving the AICD system at a well site, however, production needs for the well operator or a well site may have changed. For instance, the well operator may learn new information about the well that would necessitate an AICD system configured for different production capabilities. Alternatively, the well operator may desire to use the manufactured AICD system at a different well site where the production needs and/or capabilities are different. Accordingly, it may prove advantageous to have an AICD system that is adjustable on-site by the well operator.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention generally relates to wellbore flow control devices and, more specifically, to making on-site field adjustments to autonomous inflow control devices.

Disclosed are various ways for a well operator to make on-site adjustments to autonomous inflow control device assemblies prior to deployment downhole. As described herein below, the well operator may be able to remove a cover plate from the autonomous inflow control device assembly in order to expose a fluid compartment that houses an autonomous inflow control device. A fluid barrier may then be selectively installed within the fluid compartment in order to substantially isolate the autonomous inflow control device from any incoming fluids from a surrounding subterranean formation. As a result, the well operator may have the ability to strategically adjust fluid flow capabilities of an autonomous inflow control device assembly in the field.

As used herein, the term "on-site" refers to a rig location or field location where an autonomous inflow control device (AICD) system or assembly may be delivered and otherwise following its discharge from a manufacturer's facility. The term may also refer to any location that the AICD system or assembly might encounter or otherwise be located prior to being deployed downhole for operation.

Figure 1:
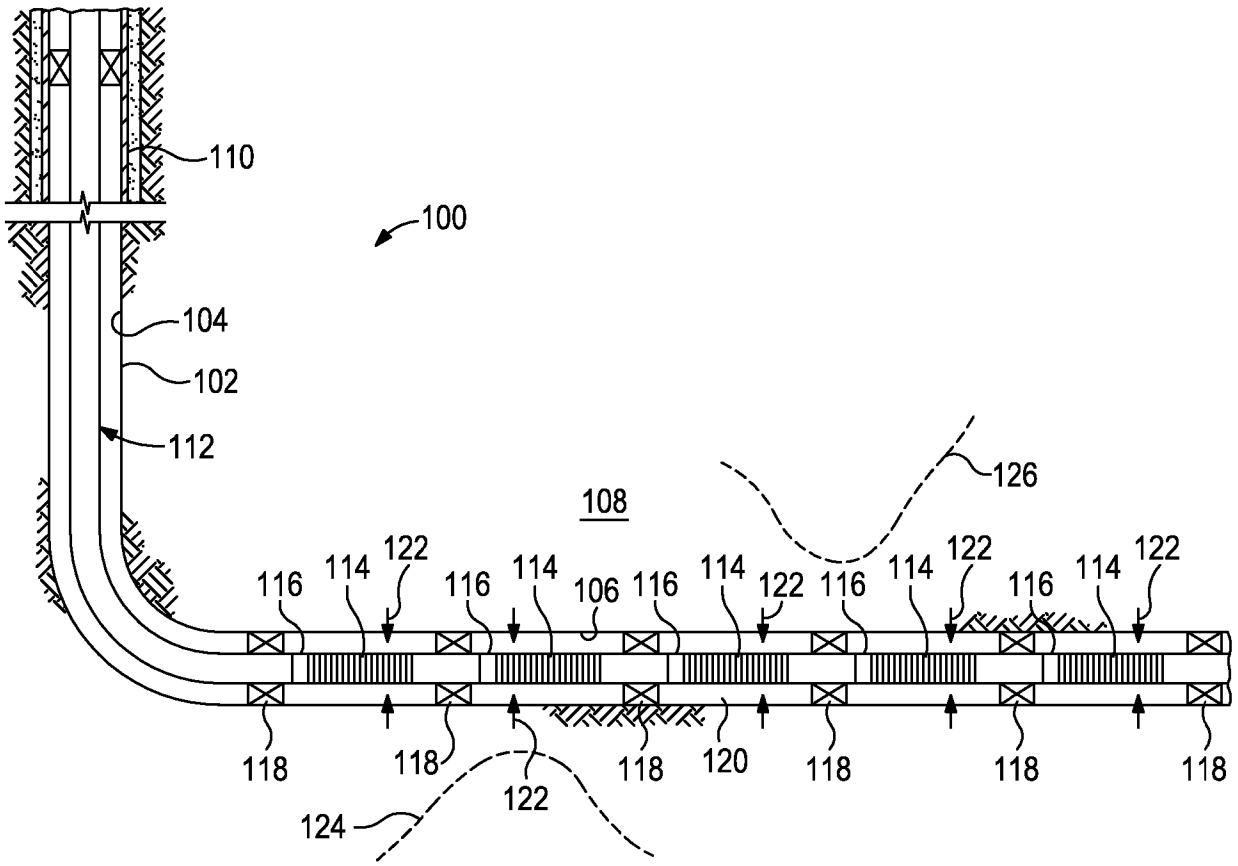
FIG. 1 illustrates a well system that can embody principles of the present disclosure, according to one or more embodiments.

Referring to FIG. 1, illustrated is a well system 100 which can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. The well screens 114 may be swell screens, wire wrap screens, mesh screens, sintered screens, expandable screens, pre-packed screens, treating screens, or other known screen types. In operation, the well screen 114 may be configured to filter the fluids 122 flowing into the production tubular 112 from the annulus 120. The inflow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and inflow control device 116 be positioned between a pair of packers 118. Nor is it necessary for a single inflow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Figure 2:
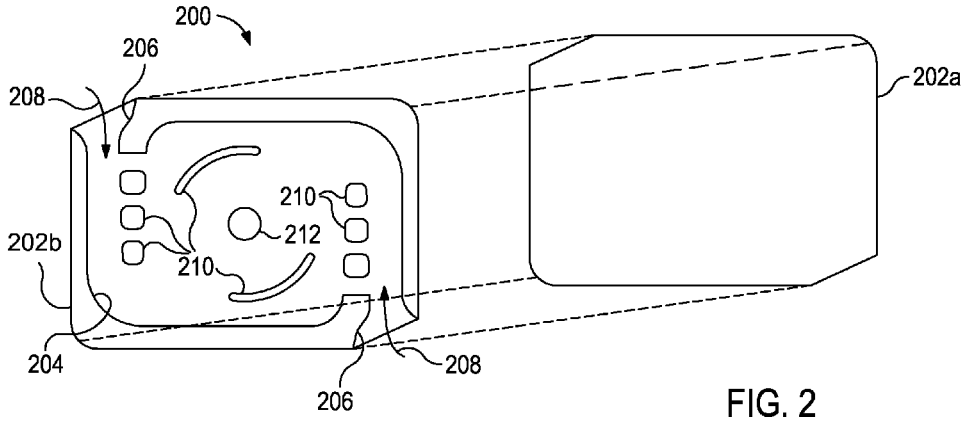
FIG. 2 illustrates an exploded top view of an exemplary autonomous inflow control device, according to one or more embodiments.

Referring now to FIG. 2, with continued reference to FIG. 1, illustrated is an exploded top view of an exemplary autonomous inflow control device 200, according to one or more embodiments. The autonomous inflow control device 200 (hereafter "AICD 200") may be any one of the flow control devices 116 shown in FIG. 1 and otherwise form part of an autonomous inflow control device (AICD) assembly. The AICD 200 may be made of, for example, tungsten carbide, but may be made of any other materials known to those skilled in the art. As illustrated, the AICD 200 may include a top plate 202*a* and a bottom plate 202*b*. The top plate 202*a* may be configured to be coupled or otherwise secured to the bottom plate 202*b* in order to define a flow chamber 204 therebetween within the AICD 200. The top plate 202*a* may be coupled to the bottom plate 202*b* using a variety of techniques including, but not limited to, mechanical fasteners, adhesives, welding, brazing, heat shrinking, combinations thereof and the like.

The bottom plate 202*b* may define one or more fluid inlets 206 (two shown) that provide fluid access into the flow chamber 204. While two fluid inlets 206 are depicted in FIG. 2, those skilled in the art will readily recognize that the AICD 200 is shown merely for illustrative purposes and other exemplary AICDs may have only one fluid inlet or more than two fluid inlets, without departing from the scope of the disclosure. The fluid inlets 206 may be configured to receive a flow of a fluid 208 therethrough and direct the fluid 208 into the flow chamber 204. The fluid 208 may be a fluid composition originating from a surrounding formation 108 (FIG. 1), for example, and may include one or more fluid components, such as oil and water, oil and gas, gas and water, oil, water and gas, etc.

The bottom plate 202*b* of the AICD 200 may further provide or otherwise define various internal structures 210 and an outlet 212. The AICD 200 may be configured to resist the flow of the fluid 208 therethrough based on one or more characteristics of the fluid 208, such as density, viscosity, and/or velocity of the fluid 208 or its various fluid components. More specifically, the internal structures 210 may be configured to induce spiraling of the flow of the fluid 208 about the outlet 212. As a result, the fluid 208 may be subjected to centrifugal or vortex forces that may cause various components of the fluid 208 that are more viscous to collect or otherwise congregate more rapidly at the outlet 212, while components of the fluid 208 that are less viscous to flow to the outlet 212 less rapidly. As a result, the AICD 200 may provide a greater resistance to the flow of undesired fluids (e.g., water, gas, etc.) than desired fluids (e.g., oils), particularly as the percentage of the undesired fluids increases.

Figure 3:
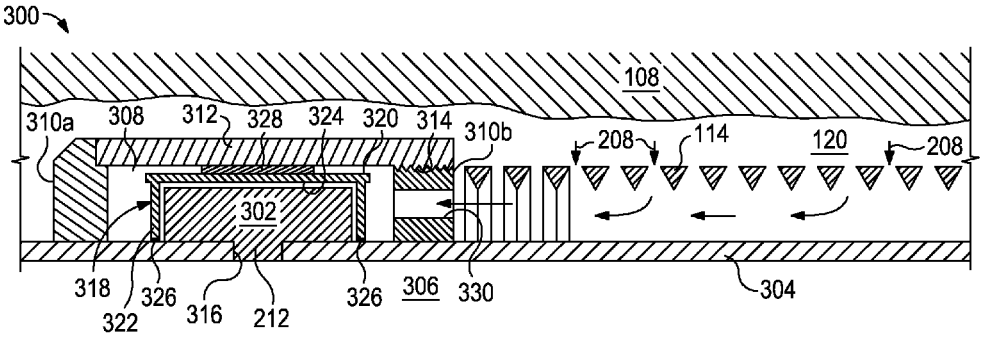
FIG. 3 illustrates an enlarged cross-sectional view of an exemplary autonomous inflow control device assembly, according to one or more embodiments.

Referring now to FIG. 3, with continued reference to FIGS. 1 and 2, illustrated is an enlarged cross-sectional view of an exemplary autonomous inflow control device assembly 300, according to one or more embodiments. As illustrated, the autonomous inflow control device assembly 300 (hereafter "AICD assembly 300") includes at least one autonomous flow control device 302 (hereafter "AICD 302"). The AICD 302 may be similar to the AICD 200 of FIG. 2 and/or may be any one of the flow control devices 116 depicted in FIG. 1. A portion of a well screen 114 is also depicted and may be operably coupled to or otherwise generally arranged about the exterior of a base pipe 304. The base pipe 304 may be or otherwise form part of the production tubing 112 of FIG. 1 and may define an interior 306 for the receipt of the fluid 208 after potentially passing through the AICD 302.

The AICD 302 may be arranged within a fluid compartment 308 generally defined by a housing that may encompass a first end ring 310*a*, a second end ring 310*b*, a cover plate 312, and a corresponding portion of the base pipe 304. The first and second end rings 310*a,b* may be characterized as structural elements that may be coupled to or otherwise form an integral part of the base pipe 304. In some embodiments, the AICD 302 may be shrink-fitted into the base pipe 304 and thereby secure the AICD 302 therein for long-term operation. More particularly, the outlet 212 of the AICD 302 may extend into and otherwise be secured within a corresponding flow port 316 defined in the base pipe 304, thereby placing the AICD 302 in fluid communication with the interior 306 of the base pipe 304. In other embodiments, the AICD 302 may be threaded, brazed, or welded into its corresponding flow port 316, without departing from the scope of the disclosure.

As mentioned above, as an autonomous inflow control device the AICD 302 may be configured to resist the flow of the fluid 208 therethrough based on one or more characteristics of the fluid 208, such as the density, the viscosity, and/or the velocity of the fluid 208 or its various fluid components. Moreover, while only one AICD 302 is shown in FIG. 3, those skilled in the art will readily recognize that the AICD assembly 300 may include several flow control devices (e.g., AICDs) arranged about the circumference of the base pipe 304 and otherwise within the fluid compartment 308 or otherwise within individual fluid compartments for additional corresponding AICDs.

In at least one embodiment, the cover plate 312 may extend between the first and second end rings 310*a,b* and generally provide a removable sleeve or cover that allows a well operator to access the fluid compartment 308 on-site prior to deploying the AICD assembly 300 downhole. The cover plate 312 may be removably coupled to at least one of the end rings 310*a,b* in a variety of ways. For instance, in some embodiments, the cover plate 312 may be mechanically-fastened to at least one of the first and second end rings 310*a,b* using one or more mechanical fasteners (not shown). In other embodiments, as illustrated, the cover plate 312 may be threaded or threadably attached to at least one of the end rings 310*a,b*. For example, the second end ring 310*b* may define or otherwise provide a series of threads 314 configured to mate with corresponding threads defined on the cover plate 312.

In order to expose the fluid compartment 308, and thereby allow a well operator on-site access to the AICD 302, the cover plate 312 may be decoupled from one or both of the first and second end rings 310*a,b*. Exposing the fluid compartment 308 prior to deploying the AICD assembly 300 downhole may prove advantageous in the event a well operator desires to make on-site fluid flow adjustments or modifications to the AICD assembly 300. For instance, the AICD assembly 300 may arrive at a well site with a particular manufacturer design applied thereto corresponding to predetermined flow characteristics for each AICD 302. According to the present disclosure, the well operator may be able to access the AICD(s) 302 by removing the cover plate 312 in order to make certain adjustments to the AICD assembly 300, and thereby undertake on-site field adjustments to the amount of fluid being introduced into the base pipe 304 during operation. Once the desired on-site fluid flow adjustments have been made, the AICD assembly 300 may then be deployed downhole for operation.

According to the present disclosure, the well operator may access the fluid compartment 308 in order to place a fluid barrier 318 around the AICD 302. The fluid barrier 318 may serve to substantially isolate the AICD 302 from the influx of the fluid 208 during downhole operation. In the illustrated embodiment, the fluid barrier 318 is depicted as a generally hollow, cap-like structure configured to envelop or otherwise encapsulate the AICD 302 within the fluid compartment 308. The fluid barrier 318 may be made of any rigid material including, but not limited to, metals, carbides, plastics, hardened rubbers or elastomers, ceramics, composite materials, combinations thereof, and the like.

As illustrated, the fluid barrier 318 may include a top 320, a wall 322 that extends downwardly from the top 320, and an open-ended cavity 324 cooperatively defined by the top 320 and the wall 322. The volume of the cavity 324 may be configured to accommodate the AICD 302 as the wall 322 extends about the periphery of the AICD 302. In some embodiments, the fluid barrier 318 may include one or more sealing elements 326 (one shown) arranged between the wall 322 and the outer surface of the base pipe 304, and thereby forming a sealed interface at that location. The sealing element 326 may be, for example, an O-ring or the like that prevents the migration of fluids.

Once the fluid barrier 318 is properly installed in the fluid compartment 308 and generally encapsulates the AICD 302, the cover plate 312 may then be re-coupled to the first and second end rings 310*a,b*. In some embodiments, the bottom of the cover plate 312 may radially engage the top 320 of the fluid barrier 318 and thereby secure the fluid barrier 318 within the fluid compartment 308 and also help increase the sealing engagement of the sealing element 326.

In other embodiments, however, a spacer member 328 may be included in the AICD assembly 300 and arranged between the top 320 and the cover plate 312 within the fluid compartment 308 to help secure the fluid barrier 318 within the fluid compartment 308 for downhole operation. The spacer member 328 may be any rigid or semi-rigid material that may extend between the bottom surface of the cover plate 312 and the top 320 of the fluid barrier 318. In some embodiments, for example, the spacer member 328 may be made of metal. In other embodiments, however, the spacer member 328 may be made of a rubber or another elastomeric material configured to provide a constant degree of spring force against the top 320 such that continuous engagement with the wall 322 and the outer radial surface of the base pipe 304 results, even in the presence of common downhole temperature fluctuations. In yet other embodiments, the spacer member 328 may be a swellable material configured to increase in size and therefore enhance the engagement between the cover plate 312 and the fluid barrier 318.

In exemplary operation, a fluid 208 from the annulus 120 may be drawn through the well screen 114 and is thereby filtered before flowing into a flow port or conduit 330 defined in the second end ring 310*b*. The conduit 330 may extend through the second end ring 310*b* and thereby place the fluid compartment 308 in fluid communication with the annulus 120 via the well screen 114. The fluid 208 may be a fluid composition originating from the surrounding formation 108 and may include one or more fluid components, such as oil and water, oil and gas, gas and water, oil, water and gas, etc. Once in the fluid compartment 308, the fluid 208 may be substantially prevented from entering the AICD 302 by the fluid barrier 318 and therefore unable to enter the interior 306 of the base pipe 304. Accordingly, by accessing the fluid compartment 308 prior to deployment, a well operator is able to install the fluid barrier 318 therein and thereby selectively reduce the flow of fluid 208 into the interior 306 of the base pipe 304.

Figure 4A:
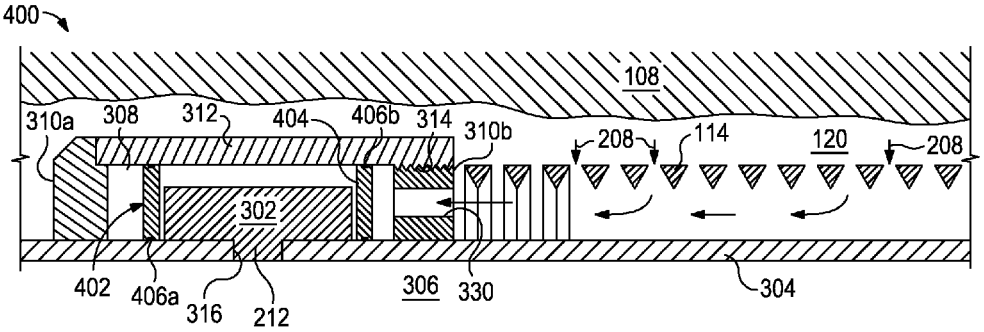
FIG. 4A illustrates an enlarged cross-sectional view of another exemplary autonomous inflow control device assembly, according to one or more embodiments.
Figure 4B:
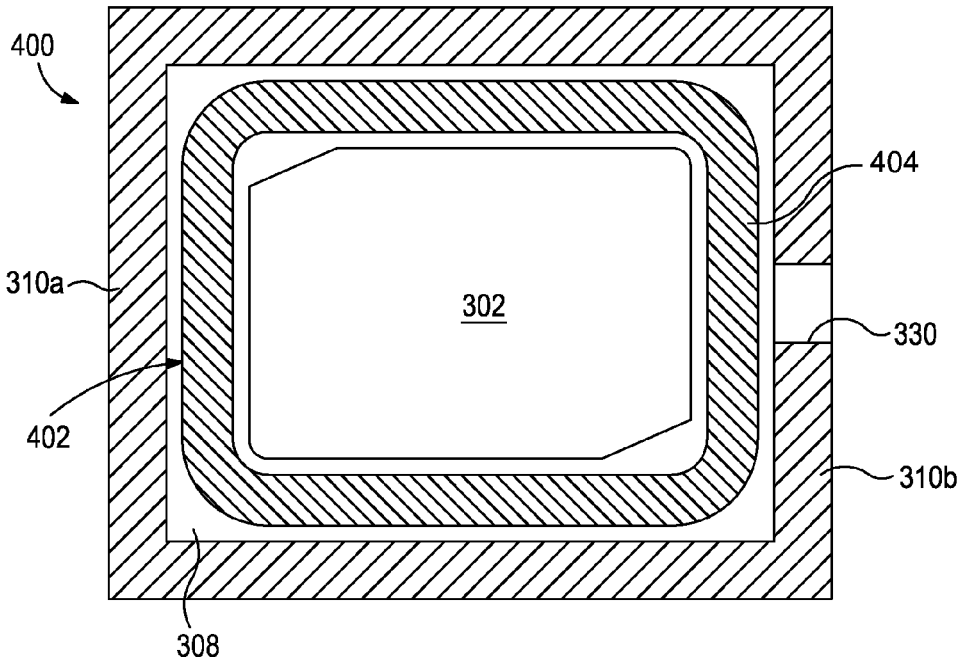
FIG. 4B illustrates an exposed top cross-sectional view of the autonomous inflow control device assembly of FIG. 4A, according to one or more embodiments.

Referring now to FIGS. 4A and 4B, illustrated is another exemplary autonomous inflow control device assembly 400, according to one or more embodiments. More particularly, FIG. 4A depicts an enlarged cross-sectional view of the autonomous inflow control device assembly 400 (hereafter "AICD assembly 400") and FIG. 4B depicts an exposed top cross-sectional view of the AICD assembly 400. The AICD assembly 400 may be similar in some respects to the AICD assembly 300 of FIG. 3 and therefore will be best understood with reference thereto, where like numerals correspond to like elements not described again in detail. For instance, similar to the AICD assembly 300 of FIG. 3, the AICD assembly 400 may include the AICD 302 arranged within the fluid compartment 308 and coupled to the base pipe 304 at a corresponding flow port 316 defined therein. The AICD assembly 400 may also include the cover plate 312 that may be removed by a well operator on-site to expose the fluid compartment 308 and otherwise access the AICD 302. Again, while only one AICD 302 is depicted in FIGS. 4A and 4B, it will be appreciated that the AICD assembly 400 may include multiple AICDs, without departing from the scope of the disclosure.

The AICD assembly 400 may further include a fluid barrier 402 that may be installed or otherwise arranged in the fluid compartment 308 by a well operator on-site prior to deploying the AICD assembly 400 downhole. As with the fluid barrier 318 of FIG. 3, the fluid barrier 402 may be configured to surround the AICD 302 within the fluid compartment 308 and thereby substantially isolate the AICD 302 from the influx of fluids 208 during operation. Moreover, the fluid barrier 402 may be made of any rigid material including, but not limited to, metals, carbides, plastics, hardened rubbers or elastomers, ceramics, composite materials, combinations thereof, and the like.

In the illustrated embodiment, the fluid barrier 402 may be a generally annular structure having a wall 404 that is large enough to extend about the periphery of the AICD 302. Moreover, the wall 404 may extend radially between the outer surface of the base pipe 304 and the inner surface of the cover plate 312. In some embodiments, the fluid barrier 402 may include one or more sealing elements 406, shown as sealing elements 406*a* and 406*b*. A first sealing element 406*a* may be arranged between the bottom of the wall 404 and the outer surface of the base pipe 304, and a second sealing element 406*b* may be arranged between the top of the wall 404 and the inner surface of the cover plate 312. The sealing elements 406*a,b* may be configured to form sealed interfaces at their respective locations and generally prevent the fluid 208 from migrating past the fluid barrier 402. The sealing elements 406*a,b* may be, for example, O-rings or other similar sealing devices known to those skilled in the art. In other embodiments, the sealing elements 406*a,b* may be omitted from the assembly 400 and the fluid barrier 402 itself may serve as a type of sealing element that prevents the influx of fluids 208 into the AICD 302.

A well operator may be able to access the fluid compartment 308 on-site to arrange the fluid barrier 402 around the AICD 302 prior to deploying the AICD assembly 400 downhole. Once the fluid barrier 402 is properly installed, the cover plate 312 may then be re-coupled to the first and second end rings 310*a,b* for downhole operation. In exemplary operation, the fluid 208 from the annulus 120 may be drawn through the well screen 114 before flowing into a flow port or conduit 330 defined in the second end ring 310*b*. Once in the fluid compartment 308, the fluid 208 may be generally prevented from entering the AICD 302 by the fluid barrier 402 and therefore unable to enter the interior 306 of the base pipe 304. Accordingly, a well operator is able to install the fluid barrier 402 in one or more of the fluid compartments 308 of the AICD assembly 400 and thereby selectively reduce the flow of fluid 208 into the interior 306 of the base pipe 304.

Figure 5A:
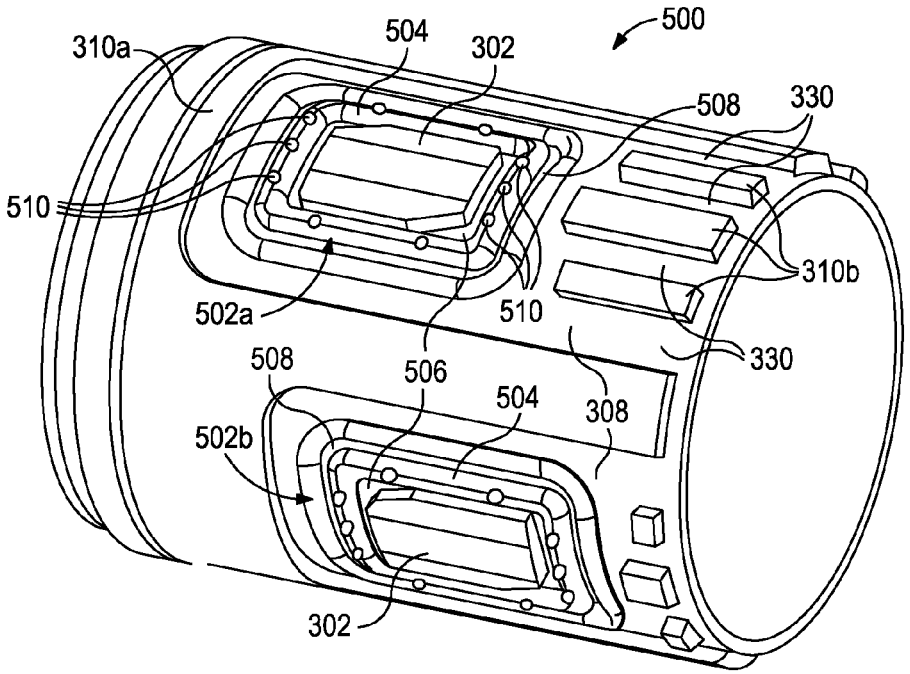
FIG. 5A depicts an isometric view of a portion of another exemplary autonomous inflow control device assembly, according to one or more embodiments.
Figure 5B:
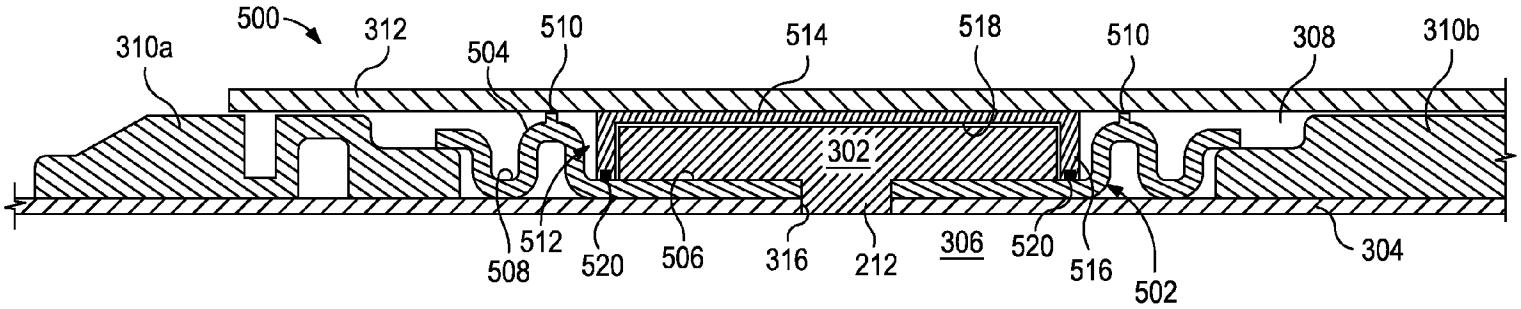
FIGS. 5B and 5C depict cross-sectional side views of a portion of the autonomous inflow control device assembly of FIG. 5A, according to one or more embodiments.
Figure 5C:
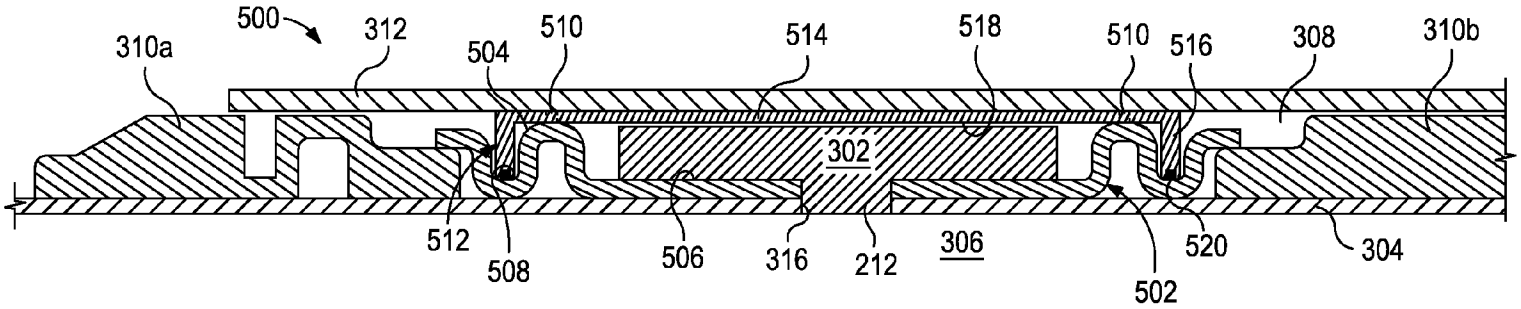

Referring now to FIGS. 5A-5C, illustrated is another exemplary autonomous inflow control device assembly 500, according to one or more embodiments. More particularly, FIG. 5A depicts an isometric view of a portion of the autonomous inflow control device assembly 500 (hereafter "AICD assembly 500"), FIG. 5B depicts a cross-sectional side view of a portion of the AICD assembly 500, according to one embodiment, and FIG. 5C depicts a cross-sectional side view of a portion of the AICD assembly 500, according to another embodiment. The AICD assembly 500 may be similar in some respects to the AICD assemblies 300, 400 of FIGS. 3 and 4, respectively, and therefore will be best understood with reference thereto, where like numerals correspond to like elements not described again in detail.

Similar to the AICD assemblies 300 and 400 of FIGS. 3 and 4, the AICD assembly 500 may include one or more AICDs 302 (two shown in FIG. 5A) arranged within corresponding fluid compartments 308 and coupled to the base pipe 304 (not shown in FIG. 5A) at corresponding flow ports 316 (FIGS. 5B and 5C) defined therein. Unlike the AICD assemblies 300, 400, however, the AICD assembly 500 further includes an insert or buckle 502 (two shown in FIG. 5A as buckles 502*a* and 502*b*) arranged within each fluid compartment 308 and configured to receive the AICD 302 therein. As illustrated, each buckle 502*a,b* may define or otherwise provide a main ridge member 504, a central cavity 506 interior to the main ridge member 504, and a trough 508 extending about the periphery of the main ridge member 504. As best seen in FIG. 5A, the AICD 302 may be arranged within the central cavity 506, and both the main ridge member 504 and the trough 508 generally extend about the periphery of the AICD 302.

As shown in FIGS. 5B and 5C, the AICD assembly 500 may also include the cover plate 312 (not shown in FIG. 5A) that extends between the first and second end rings 310*a,b* and generally encloses the AICD 302 and the buckle 502 within the fluid compartment 308. In some embodiments, one or more bumps or protrusions 510 may be defined on the main ridge member 504 and configured to maintain the cover plate 312 radially offset from the main ridge member 504 a short distance so that fluids may be able to bypass the main ridge member 504 and access the central cavity 506. As with prior described embodiments, the cover plate 312 may be removed from engagement with the first and second end rings 310*a,b* by a well operator on-site in order to expose the fluid compartment 308 and otherwise provide access to the AICDs 302. As best seen in FIG. 5A, the second end ring 310*b* may include or otherwise define several flow conduits 330 (four shown for each fluid compartment 308) that may feed fluids into the fluid compartment 308 during downhole operation.

Referring to FIGS. 5B and 5C, the AICD assembly 500 may further include a fluid barrier 512 configured to be arranged within the fluid compartment 308 and, more particularly, within the buckle 502 and otherwise surrounding the AICD 302. Similar to the fluid barriers 318 and 402 of FIGS. 3 and 4, respectively, the fluid barrier 512 depicted in FIGS. 5B and 5C may be configured to substantially isolate the AICD 302 from the influx of fluids, and thereby reduce the flow of fluids into the interior 306 of the base pipe 304.

The fluid barrier 512 may be made of any rigid material including, but not limited to, metals, carbides, plastics, hardened rubbers or elastomers, ceramics, composite materials, combinations thereof, and the like.

Similar to the fluid barrier 318 of FIG. 3, in some embodiments, the fluid barrier 512 may be a generally hollow or cap-like structure configured to envelop or otherwise encapsulate the AICD 302 within the fluid compartment 308. Accordingly, the fluid barrier 512 may include a top 514, a wall 516 that extends downwardly from the top 514, and an open-ended cavity 518 cooperatively defined by the top 514 and the wall 516. While not shown, a spacer member (similar to the spacer member 328 of FIG. 3) may be included in the AICD assembly 500 and placed between the top 514 and the cover plate 312 to help secure the fluid barrier 512 within the fluid compartment 308 when the cover plate 312 is secured.

In other embodiments, however, the fluid barrier 512 may instead be a generally annular structure, similar to the fluid barrier 402 of FIGS. 4A and 4B. More particularly, the top 514 may be omitted from the fluid barrier 512 and the wall 516 may extend generally about the periphery of the AICD 302. In such embodiments, the wall 516 may be configured to extend radially between the outer surface of various portions of the buckle 502 and the inner surface of the cover plate 312.

In some embodiments, the fluid barrier 512 may further include one or more sealing elements 520 arranged between the bottom of the wall 516 and the outer surface of the buckle 502, thereby forming a sealed interface at that location. In embodiments where the top 514 is omitted, additional sealing elements (not shown) may be arranged between the skirt/wall 516 and the inner surface of the cover plate 312 and form a sealed interface at that location also. The sealing elements 520 may be, for example, O-rings or other like sealing devices known to those skilled in the art.

In FIG. 5B, the fluid barrier 512 is depicted as being arranged generally within the central cavity 506 of the buckle 502 and otherwise directly adjacent or otherwise encompassing the AICD 302. The volume of the cavity 518 may be configured to accommodate the AICD 302 therein as the wall 516 extends about the entire periphery of the AICD 302.

In FIG. 5C, the wall 516 is depicted as being seated within or otherwise extended into the trough 508 of the buckle 502. The volume of the cavity 518 may be configured to accommodate the AICD 302 and the main ridge member 504 as the wall 516 extends about the AICD 302 within the trough 508. In the embodiment shown in FIG. 5C, one or more grooves, slots, or perforations (not shown) may be defined within the fluid barrier 512 to accommodate the protrusions 510 defined on the main ridge member 504.

As with prior embodiments, a well operator may remove the cover plate 312 on-site prior to deploying the AICD assembly 500 in order to access the fluid compartment 308 and selectively arrange the fluid barrier 512 around one or more of the AICDs 302 associated with the AICD assembly 500. In some embodiments, the fluid barrier 512 may be coupled or attached to the buckle 502 using, for example, one or more mechanical fasteners (e.g., screws, bolts, snap rings, pins, etc.), welding or brazing techniques. In other embodiments, the fluid barrier 512 may rely on an interference fit provided by placement of the cover plate 312. In at least one embodiment, the fluid barrier 512 may further include one or more axial extension (not shown) configured to interlock with a corresponding one or more slots (not shown) defined on the buckle 502 (e.g., defined on the main ridge member 504 or within the trough 508). The axial extensions may be configured to help hold the buckle 502 in place during the assembling process.

Once the fluid barrier 512 is properly installed in the fluid compartment 308 and generally encapsulates the AICD 302, the cover plate 312 may then be re-coupled to the first and second end rings 310*a,b*. In exemplary operation downhole, the fluid 208 may be drawn into the fluid compartment 308 via the flow conduits 330 (FIG. 5A) defined in the second end ring 310*b*. Once in the fluid compartment 308, the fluid 208 may be generally prevented from entering the AICD 302 by the fluid barrier 512 and therefore unable to enter the interior 306 of the base pipe 304. Accordingly, a well operator may be able to install the fluid barrier 512 in one or more of the fluid compartments 308 of the AICD assembly 500 and thereby selectively reduce the flow of fluid 208 into the interior 306 of the base pipe 304.

Embodiments disclosed herein include:

A. An autonomous inflow control device (AICD) assembly that includes a base pipe defining one or more flow ports and an interior, at least one AICD arranged on the base pipe and having at least one fluid inlet and an outlet in fluid communication with one of the one or more flow ports, and a fluid barrier configured to be arranged about the at least one AICD by a well operator on-site and configured to isolate the at least one AICD from an influx of fluid during operation.

B. A method that includes receiving an autonomous inflow control device (AICD) assembly subsequent to its manufacture, the AICD assembly including a base pipe defining one or more flow ports and an interior, the AICD assembly further including at least one AICD arranged on the base pipe and having at least one fluid inlet and an outlet in fluid communication with one of the one or more flow ports, arranging a fluid barrier about the at least one AICD on-site, deploying the AICD assembly into a wellbore after arranging the fluid barrier about the at least one AICD, and preventing an influx of fluid into the at least one AICD with the fluid barrier.

Each of embodiments A and B may have one or more of the following additional elements in any combination: Element 1: wherein the fluid barrier is made of at least one of a metal, a carbide, a plastic, a hardened rubber or elastomer, a ceramic, a composite material, and any combination thereof. Element 2: wherein the fluid barrier comprises a top, a wall extending from the top, and an open-ended cavity cooperatively defined by the top and the wall, wherein the open-ended cavity is configured to accommodate the at least one AICD therein as the wall extends about a periphery of the at least one AICD. Element 3: further comprising a cover plate mechanically coupled to a structural feature connected to the base pipe and configured to be removed by the well operator on-site to provide access to the at least one AICD, wherein the cover plate engages the top when coupled to the structural feature. Element 4: further comprising a spacer member interposing the top and the cover plate. Element 5: further comprising a buckle arranged on the base pipe and providing a main ridge member, a central cavity defined interior to the main ridge member, and a trough extending about the periphery of the main ridge member, wherein the at least one AICD is arranged in the central cavity. Element 6: wherein the wall extends radially between an inner surface of the cover plate and an outer surface of at least one of the central cavity and the trough. Element 7: wherein the fluid barrier comprises an annular wall that extends about a periphery of the at least one AICD. Element 8: further comprising a cover plate mechanically coupled to a structural feature connected to the base pipe and configured to be removed by the well operator on-site to provide access to the at least one AICD, wherein the cover plate engages the annular wall when coupled to the structural feature. Element 9: wherein the annular wall extends radially between an outer surface of the base pipe and an inner surface of the cover plate. Element 10: further comprising a buckle arranged on the base pipe and providing a main ridge member, a central cavity defined interior to the main ridge member, and a trough extending about the periphery of the main ridge member, wherein the at least one AICD is arranged in the central cavity. Element 11: wherein the wall extends radially between an inner surface of the cover plate and an outer surface of at least one of the central cavity and the trough.

Element 12: wherein the fluid barrier includes a top, a wall extending from the top, and an open-ended cavity cooperatively defined by the top and the wall, and wherein arranging the fluid barrier about the at least one AICD comprises accommodating the at least one AICD within the open-ended cavity as the wall extends about a periphery of the at least one AICD. Element 13: further comprising removing a cover plate mechanically coupled to the base pipe and radially offset from the AICD, placing the fluid barrier about the at least one AICD, and re-coupling the cover plate to the base pipe to secure the fluid barrier about the at least one AICD. Element 14: further comprising engaging the top with the cover plate. Element 15: further comprising placing a spacer member between the top and the cover plate. Element 16: wherein a buckle is arranged on the base pipe and provides a main ridge member, a central cavity defined interior to the main ridge member and configured to receive the at least one AICD, and a trough extending about the periphery of the main ridge member, the method further comprising arranging the fluid barrier in the buckle so that the wall extends radially between an inner surface of the cover plate and an outer surface of at least one of the central cavity and the trough. Element 17: wherein the fluid barrier comprises an annular wall that extends about a periphery of the at least one AICD, and wherein arranging the fluid barrier about the at least one AICD comprises removing a cover plate mechanically coupled to the base pipe and radially offset from the AICD, placing the fluid barrier about the at least one AICD, and re-coupling the cover plate to the base pipe to secure the fluid barrier about the at least one AICD. Element 18: wherein placing the fluid barrier about the at least one AICD comprises arranging the fluid barrier so that the wall extends radially between an outer surface of the base pipe and an inner surface of the cover plate. Element 19: wherein a buckle is arranged on the base pipe and provides a main ridge member, a central cavity defined interior to the main ridge member and configured to receive the at least one AICD, and a trough extending about the periphery of the main ridge member, the method further comprising arranging the fluid barrier in the buckle so that the wall extends radially between an inner surface of the cover plate and an outer surface of at least one of the central cavity and the trough.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. An autonomous inflow control device (AICD) assembly, comprising:

a base pipe defining one or more flow ports and an interior;

at least one AICD arranged on the base pipe and having at least one fluid inlet and an outlet in fluid communication with one of the one or more flow ports;

a fluid barrier, wherein the entirety of the fluid barrier is configured to be arranged about and outside the at least one AICD by a well operator on-site and configured to isolate the at least one AICD from the one or more flow ports during operation; and a cover plate configured to be coupled to the base pipe and configured to be removed by the well operator on-site to provide access to the at least one AICD, wherein the cover plate engages the fluid barrier when coupled to the base pipe.

2. The AICD assembly of claim 1, wherein the fluid barrier is made of at least one of a metal, a carbide, a plastic, a hardened rubber or elastomer, a ceramic, a composite material, and any combination thereof.

3. The AICD assembly of claim 1, wherein the fluid barrier comprises:

a top;

a wall extending from the top; and an open-ended cavity cooperatively defined by the top and the wall, wherein the open-ended cavity is configured to accommodate the at least one AICD therein as the wall extends about a periphery of the at least one AICD.

4. The AICD assembly of claim 3, wherein the cover plate engages the top when coupled to the base pipe.

5. The AICD assembly of claim 4, further comprising a spacer member interposing the top and the cover plate, wherein the cover plate engages the fluid barrier via the spacer member.

6. The AICD assembly of claim 4, further comprising a buckle arranged on the base pipe and providing a main ridge member, a central cavity defined interior to the main ridge member, and a trough extending about the periphery of the main ridge member, wherein the at least one AICD is arranged in the central cavity.

7. The AICD assembly of claim 6, wherein the wall extends radially between an inner surface of the cover plate and an outer surface of at least one of the central cavity and the trough.

8. The AICD assembly of claim 1, wherein the fluid barrier comprises an annular wall that extends about a periphery of the at least one AICD.

9. The AICD assembly of claim 8, wherein the cover plate engages the annular wall when coupled to the base pipe.

10. The AICD assembly of claim 9, wherein the annular wall extends radially between an outer surface of the base pipe and an inner surface of the cover plate.

11. The AICD assembly of claim 9, further comprising a buckle arranged on the base pipe and providing a main ridge member, a central cavity defined interior to the main ridge member, and a trough extending about the periphery of the main ridge member, wherein the at least one AICD is arranged in the central cavity.

12. The AICD assembly of claim 11, wherein the annular wall extends radially between an inner surface of the cover plate and an outer surface of at least one of the central cavity and the trough.

13. A method, comprising:

receiving an autonomous inflow control device (AICD) assembly, the AICD assembly including a base pipe defining one or more flow ports and an interior, the AICD assembly further including at least one AICD arranged on the base pipe and having at least one fluid inlet and an outlet in fluid communication with one of the one or more flow ports;

arranging a fluid barrier, wherein the entirety of the fluid barrier is arranged about and outside the at least one AICD on-site, such that the at least one AICD is isolated from the one or more flow ports;

coupling a cover plate to the base pipe, wherein the cover plate engages the fluid barrier when coupled to the base pipe; and deploying the AICD assembly into a wellbore after arranging the fluid barrier about the at least one AICD.

14. The method of claim 13, wherein the fluid barrier includes a top, a wall extending from the top, and an open-ended cavity cooperatively defined by the top and the wall, and wherein arranging the fluid barrier about the at least one AICD comprises accommodating the at least one AICD within the open-ended cavity as the wall extends about a periphery of the at least one AICD.

15. The method of claim 13, further comprising:

prior to the arranging, removing the cover plate from the base pipe.

16. The method of claim 14, wherein the coupling comprises engaging the top with the cover plate.

17. The method of claim 14, wherein the coupling comprises engaging the top with the cover plate via a spacer member between the top and the cover plate.

18. The method of claim 14, wherein a buckle is arranged on the base pipe and provides a main ridge member, a central cavity defined interior to the main ridge member and configured to receive the at least one AICD, and a trough extending about the periphery of the main ridge member; and wherein the arranging comprises arranging the fluid barrier in the buckle so that the wall extends radially between an inner surface of the cover plate and an outer surface of at least one of the central cavity and the trough.

19. The method of claim 13, wherein the fluid barrier comprises an annular wall that extends about a periphery of the at least one AICD, and wherein the arranging the fluid barrier about the at least one AICD comprises:

removing the cover plate mechanically coupled to the base pipe and radially offset from the AICD; and placing the fluid barrier about the at least one AICD.

20. The method of claim 19, wherein placing the fluid barrier about the at least one AICD comprises arranging the fluid barrier so that the annular wall extends radially between an outer surface of the base pipe and an inner surface of the cover plate.

21. The method of claim 19, wherein a buckle is arranged on the base pipe and provides a main ridge member, a central cavity defined interior to the main ridge member and configured to receive the at least one AICD, and a trough extending about the periphery of the main ridge member; and wherein the arranging comprises arranging the fluid barrier in the buckle so that the annular wall extends radially between an inner surface of the cover plate and an outer surface of at least one of the central cavity and the trough.

* * * * *